US009821987B2

(12) United States Patent
Vogel et al.

(10) Patent No.: US 9,821,987 B2
(45) Date of Patent: Nov. 21, 2017

(54) ADJUSTABLE UNIVERSAL ADAPTOR FOR A LIFTING JACK

(71) Applicants: Bosch Automotive Service Solutions Inc., Warren, MI (US); Robert Bosch GmbH, Stuttgart (DE)

(72) Inventors: Michael T. Vogel, Faribault, MN (US); Atul H. Patel, Burnsville, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/975,257

(22) Filed: Dec. 18, 2015

(65) Prior Publication Data

US 2017/0174485 A1 Jun. 22, 2017

(51) Int. Cl.
*B66F 5/00* (2006.01)
*B66F 3/38* (2006.01)
*B25H 1/00* (2006.01)

(52) U.S. Cl.
CPC ..... *B66F 5/00* (2013.01); *B25H 1/0007* (2013.01); *B66F 3/38* (2013.01)

(58) Field of Classification Search
None
See application file for complete search history.

(56) References Cited

U.S. PATENT DOCUMENTS 2,794,491 A * 6/1957 Hopkins ..... A47C 4/24 297/48
2,838,278 A * 6/1958 Tarbet ..... B66F 5/04 248/178.1
3,446,309 A * 5/1969 Davis ..... E06C 1/397 16/245
3,773,293 A * 11/1973 Arnes ..... B66F 3/36 254/134
4,787,600 A 11/1988 Bode
5,139,233 A 8/1992 Goss
6,089,545 A 7/2000 Norman et al.
(Continued)

OTHER PUBLICATIONS

Lincoln Multipurpose Transmission Adapter found at https://web.archive.org/web/20141120215208/http://www.iserv.net/~wmogrady/lube/jack/lincoln/transmission/w93720.html from Nov. 2014.*

*Primary Examiner* — Joseph J Hail
*Assistant Examiner* — Brian Keller
(74) *Attorney, Agent, or Firm* — Maginot, Moore & Beck LLP

(57) ABSTRACT

An adaptor is provided for a jack assembly having a lifting jack carrying a horizontal plate for raising and lowering a heavy component supported by the jack assembly. The adaptor includes a horizontal support plate fastened to and vertically offset from the horizontal plate of the jack assembly by a height. A plurality of elongated arms is slidably mounted between the two plates to move in a generally horizontal plane. Each of arms includes a holding assembly configured to engage portions of the component supported on the support plate to stabilize the component as it is raised and lowered by the jack assembly. The arms are supported in the height between the two plates at different heights so that the arms are capable of a wide range of rotational and linear movements to adjust the position of the holding assembly of each arm relative to the heavy component.

16 Claims, 7 Drawing Sheets

(56) References Cited

U.S. PATENT DOCUMENTS

| | | | | |
|---|---|---|---|---|
| 6,109,593 | A | 8/2000 | Craychee | |
| 6,286,397 | B1 * | 9/2001 | Taggart | B25F 1/04 7/118 |
| 6,457,700 | B1 * | 10/2002 | Hong | B66C 23/48 254/124 |
| 8,607,465 | B1 * | 12/2013 | Edwards | G01B 3/56 33/471 |

* cited by examiner

ADJUSTABLE UNIVERSAL ADAPTOR FOR A LIFTING JACK

BACKGROUND

The present disclosure relates to an adaptor for use with a lifting jack. The adaptor has particular use in supporting an automotive transmission or similar heavy machinery on the lifting jack.

Professionals in the automotive repair field as well as do-it-yourself technicians and mechanics must frequently remove components of a vehicle power train to either repair or overhaul the component or obtain access to other components of the power train in need of repair or overhaul. One commonly removed component of the vehicle drive train is the transmission which delivers power from the engine's crankshaft to the driveline. There are many parts on the inside of a transmission that endure high cyclic rotation and heavy loads that eventually wear out. Depending on the nature and extent of the wear the transmission may be either overhauled or replaced. In either case it is typically necessary to disconnect the transmission from the engine and driveline and remove it from the vehicle.

Due to the heavy weight of a transmission, some of which weigh over 200 pounds, the assistance of a hydraulic or mechanical lifting jack is usually necessary. To prevent the transmission from falling off the jack the technician or mechanic must properly secure it onto the lifting jack. As shown in FIG. 1, a typical assembly 10 for supporting a transmission T includes a lifting jack 12 having support legs 13 that provide a stable base to support the weight of the transmission T. The lifting jack includes a jack plate or top plate 15 mounted on the jack that provides a surface on which the transmission is seated. The top plate is typically a fixed plate sized for the transmission pan to rest on and may include various flange like components that keep the transmission from falling off the sides of the fixed plate 15. A strap or chain 16 is secured to one side of the top plate 15, fed over top of the transmission, and then secured to the other side of the top plate, as shown in FIG. 1.

The assembly 10 depicted in FIG. 1 can be sufficient and relatively easy to use when there is ample room around the installed transmission and the transmission has a flat bottom profile. However, with today's automotive designs this is often not the case. Typically, spacing around components has become more limited making it difficult to reach areas to apply tools or to weave a strap/chain around a transmission. In today's fast-paced work environment the technician/mechanic is under economic and customer pressure to complete the overhaul/replacement job as quickly as possible. Under this pressure it is not uncommon for a technician to short-cut fully securing the transmission to the lifting jack while physically supporting the transmission as it is lowered out of the vehicle. In a best case scenario two technicians help stabilize the loosely-secured transmission on the lifting jack as it is lowered. Without the strap in place this creates a safety hazard as the transmission may slide off the jack and fall to the ground damaging the transmission itself or injuring the technician.

Moreover, the designs of many transmission casings have changed from a flat, easy to stabilize bottom profile, to an often more complex shape that adapts to new technology and accommodates packaging or weight savings constraints. These design modifications has made the removal of a transmission using current adapters a less stable proposition even with the proper use.

Consequently, there is a need for an improved adaptor for a lifting jack that is easier to use, safer, and better suited for the needs of the technician or mechanic,

SUMMARY

An adaptor is provided for a jack assembly having a lifting jack carrying a horizontal plate for raising and lowering a heavy component supported by the jack assembly. The adaptor includes a horizontal support plate defining a support surface for supporting the heavy component, with the support plate fastened to and vertically offset from the horizontal plate of the jack assembly by a height. The adaptor further includes a plurality of elongated arms slidably mounted between the horizontal plate of the jack assembly and the support plate to move in a generally horizontal plane between the horizontal plate and the adaptor plate at selectable angles and horizontal extensions beyond said perimeter of said support surface. Each of the plurality of elongated arms includes a holding assembly configured to engage portions of the component supported on the support plate to stabilize the component as it is raised and lowered by the jack assembly.

In one aspect, each of the plurality of elongated arms is mounted between the horizontal plate of the jack assembly and said support plate by a single bolt that extends through an elongated slot in the arms, as well as through the support plate and the horizontal plate of the jack assembly to fasten the plates together at the height. Each of the plurality of arms is positioned at different vertical heights relative to the horizontal support plate and each of the arms is slidably mounted to move in a different corresponding horizontal plane between the horizontal plate and the adaptor plate.

In a further aspect, the adaptor includes a selection of spacers of different heights that are used in different combinations to support each of the elongated arms at their respective different heights. The spacers include a first spacer of height h1, a second spacer of height h2 and a third spacer of height h3, wherein h1=h2+h3. Two of the arms use just the first spacer but positioned on opposite sides of the respective arm to support the two arms at different heights. Two other arms use the second and third spacers, with the second spacer on top and the third spacer beneath one of the arms, and the third spacer on top and the second spacer beneath the other of the two arms, to thereby support the two arms at different heights relative to each other and to the other two elongated arms.

Each arm assembly includes a holding assembly that includes a holding rod projecting upward therefrom at adjustable heights. Each holding rod is provided with a holding element at its upper end that is configured to engage and/or clamp a surface of the heavy component, such as a transmission. The four holding elements or clamps can be used to pull down on the transmission against the lifting jack creating far greater stability by constraining side-to-side or front-to-back movement of the transmission.

DETAILED DESCRIPTION

Figure 1:
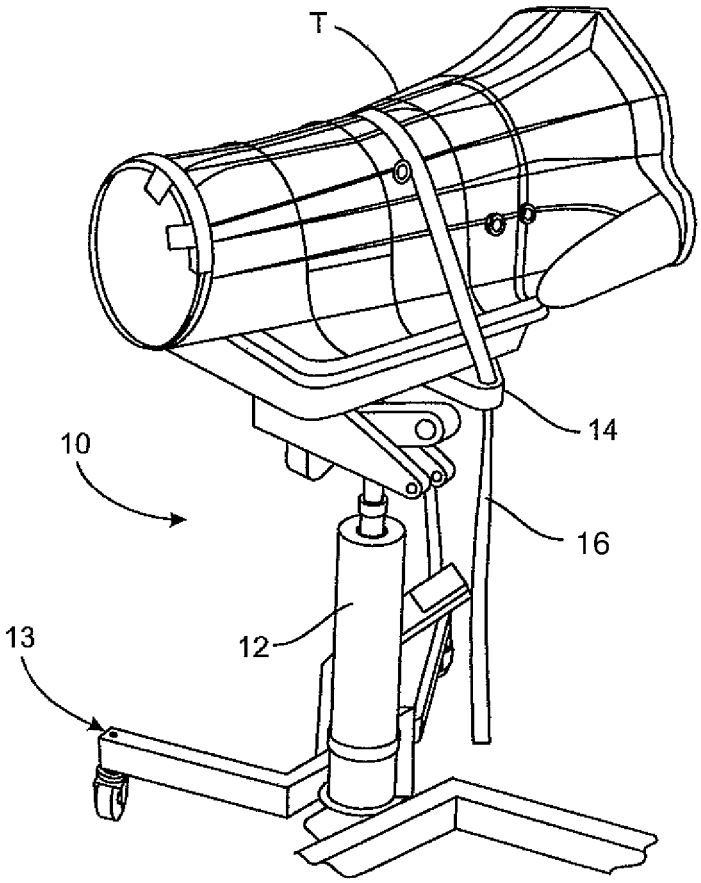
FIG. 1 (Prior Art)
FIG. 1 is a perspective view of a lifting jack with an automotive transmission strapped to the top plate of the lifting jack.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure encompasses any alterations and modifications to the illustrated embodiments and includes further applications of the principles of the disclosure as would normally occur to one skilled in the art to which this disclosure pertains.

Figure 2:
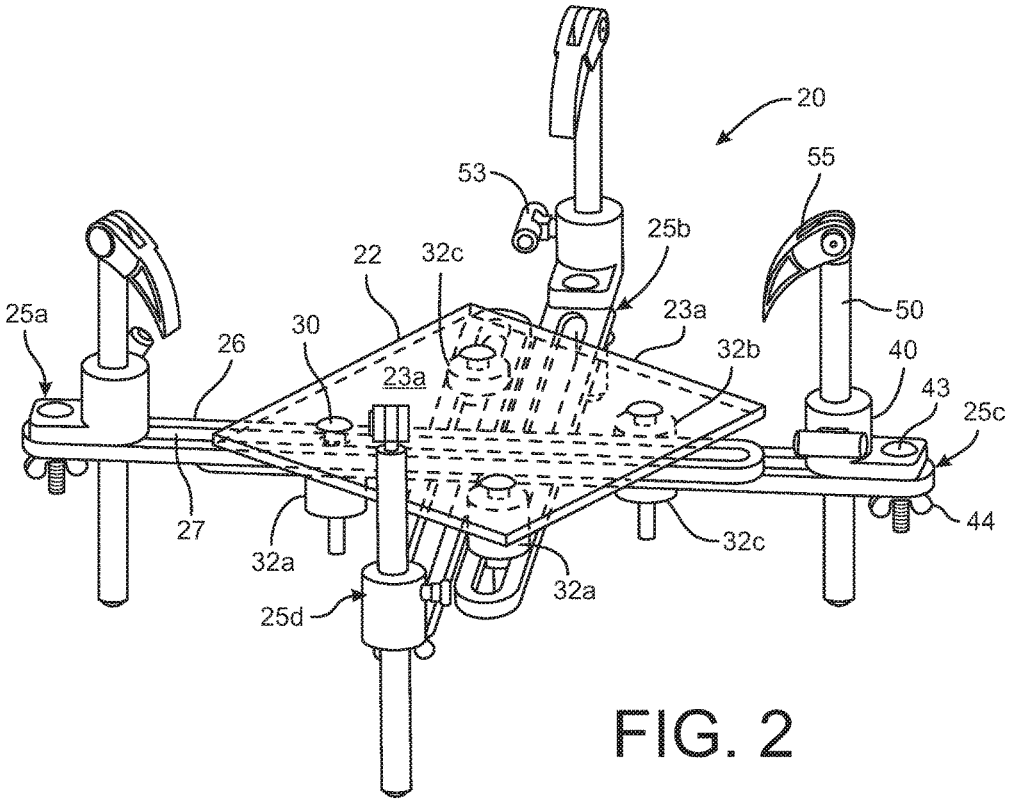
FIG. 2 is a perspective view of an adaptor according to the present disclosure for use with a lifting jack, such as the lifting jack depicted in FIG. 1.
Figure 3:
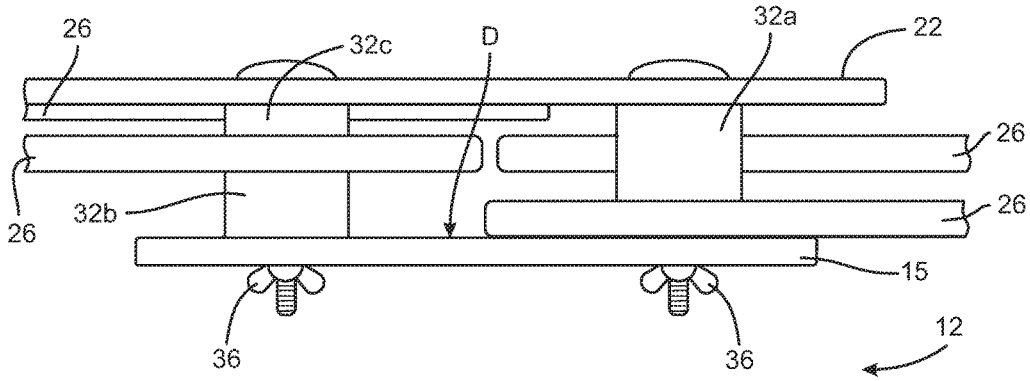
FIG. 3 is a side view of the adaptor shown in FIG. 2 mounted on the top plate of a lifting jack.
Figure 4:
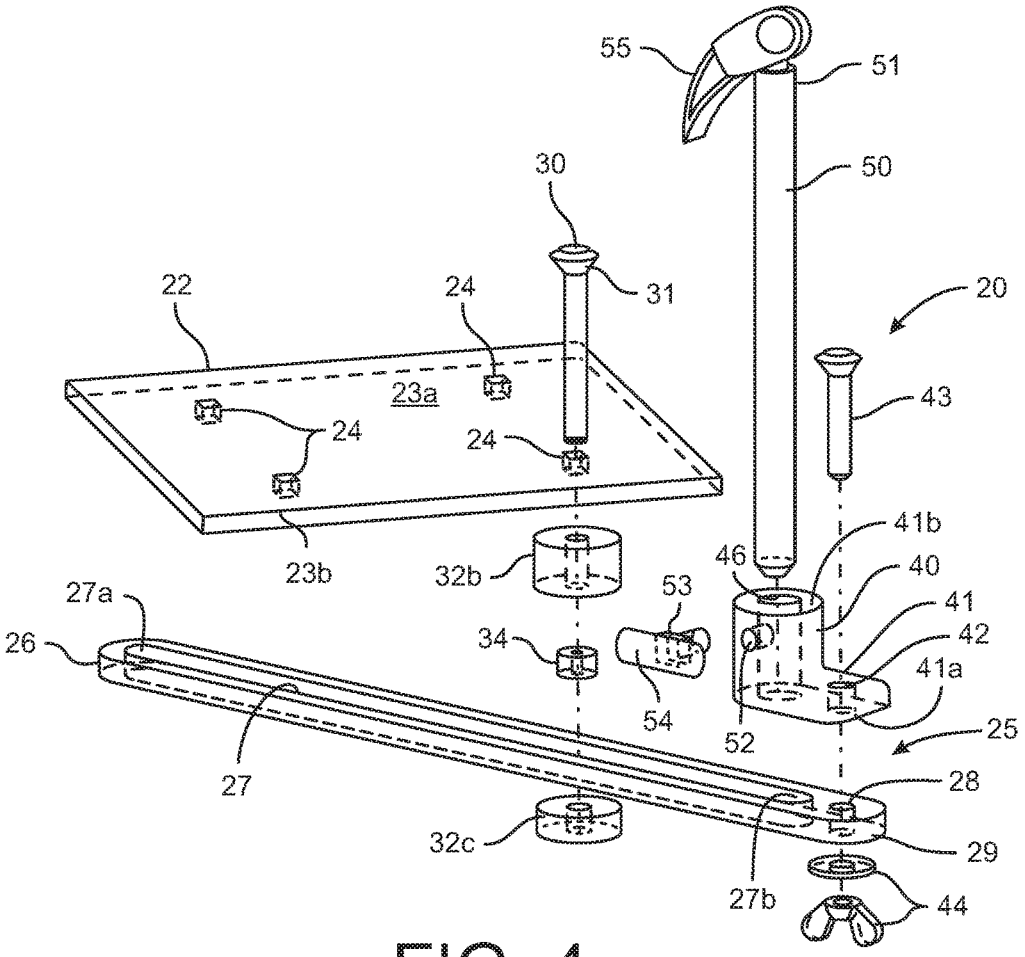
FIG. 4 is an exploded view of the components of the adaptor shown in FIG. 2.
Figure 5:
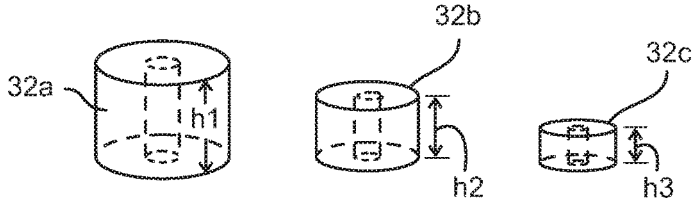
FIG. 5 is a perspective view of spacers used with the adaptor shown in FIGS. 2-4.
Figure 6:
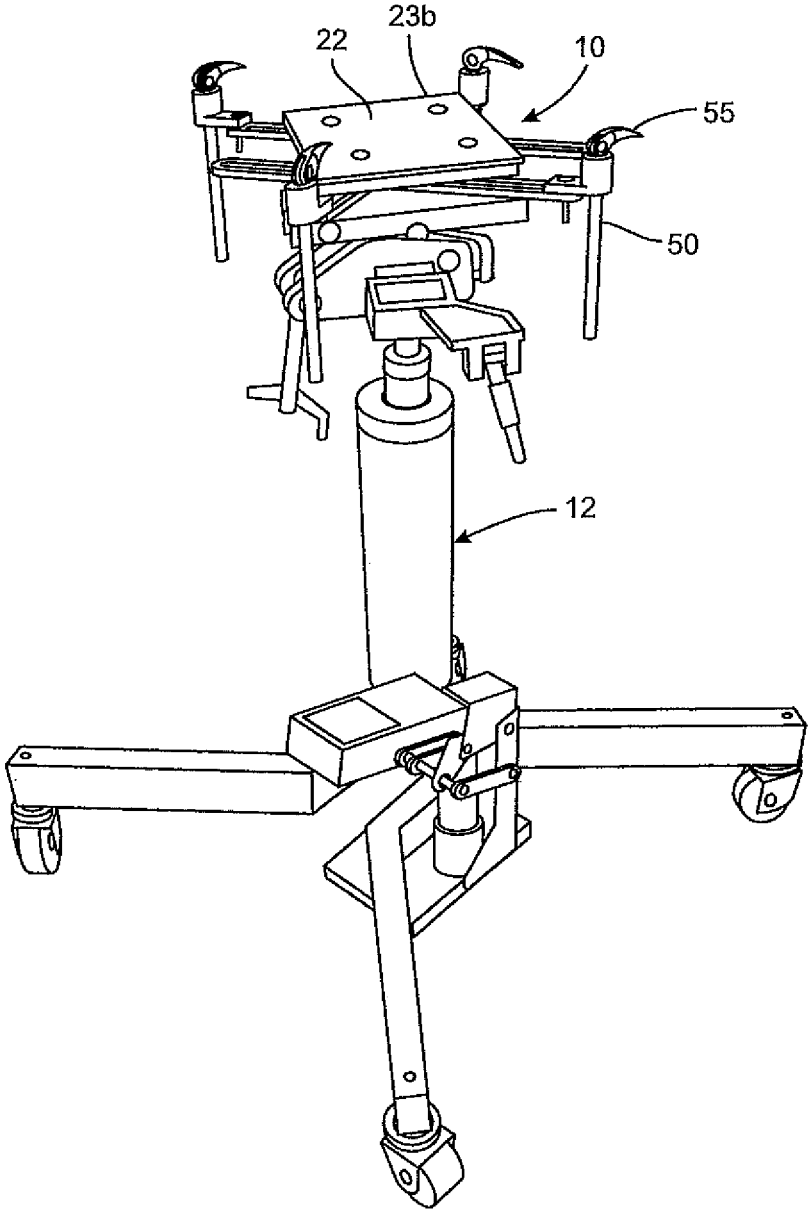
FIG. 6 is a perspective view of the adaptor shown in FIG. 2 mounted on a lifting jack with the support arms of the adaptor in a retracted position.

According to the present disclosure, the universal adaptor 20 depicted in FIGS. 2-4 is configured to be mounted to the top plate of a lifting jack, such as the top plate 15 of the lifting jack 12 shown in FIGS. 1 and 6. The universal adaptor 20 includes a support plate 22 that defines an upper surface 23*a* within a perimeter 22*b* that is configured to support the weight of a transmission, such as the transmission T shown in FIGS. 1 and 6. In the illustrated embodiment, the upper surface 23*a* is flat and the perimeter 23*b* is generally square, as shown in FIG. 2, for supporting a conventional automotive transmission. However, it is understood that the contour and shape of the upper surface 23*a* and perimeter 23*b* can vary depending on the type of heavy component being supported on the support plate 22.

The adaptor 20 includes a plurality of support arm assemblies 25 that are mounted between the top plate 15 of the lifting jack and the support plate 22, as best seen in FIGS. 3 and 6. It should be apparent that the universal adaptor 20 should include at least two arm assemblies; however, three or more such arm assemblies are preferable to provide optimum stability for a transmission or heavy drive train component supported on the lifting jack. It can be appreciated that four arm assemblies provides four points to secure the transmission so that there is little chance for the transmission to slip in any direction on the lifting jack and support plate 22.

Each arm assembly 25 includes an elongated arm 26 that defines a slot 27 extending along the majority of the length of the arm, as best seen in FIG. 4. Each slot 27 is sized to receive a mounting bolt 30 that first passes through a mounting hole 24 in the support plate 22. As shown in FIGS. 2 and 4, four mounting holes 24 are provided that correspond to four bolt holes in the top plate 15 of the lifting jack. The mounting bolts 30 thus pass through both plates 15, 22 with the elongated arms 26 of the arm assemblies 25 sandwiched between the plates. A nut 36 is threaded onto the mounting bolts 30 to clamp the universal adaptor 20 to the top plate of the lifting jack, as shown in FIG. 3. As shown in the figure, the nuts 36 can be wing nuts that can be manually tightened. It can be appreciated that the support arm assemblies 25 do not bear appreciable load since their purpose is simply to keep the transmission from slipping on the support plate 22. Moreover, the support plate 22 is loaded vertically by the weight of the transmission so that the support plate is not subjected to significant side-to-side loads. Thus, the engagement between the mounting bolts 30 and wing nuts 36 can be made sufficiently secure by manual tightening the wing nuts. Of course, conventional nuts may be employed that require the use of a wrench to tighten onto the bolts.

The mounting bolts 30 can be in the form of carriage bolts with a square head portion 31 adapted to be received in complementary square mounting holes 24 to prevent rotation of the mounting bolts 30 as the wing nuts 36 are tightened. The mounting bolts can interface with the slot 27 in the elongated arms 26 by way of a bushing 34 that is configured for a close running fit within the slot. The slots 27 in the arms 26 allow the arms to translate relative to the bushings 34, and more particularly relative to the mounting bolts 30 that are at a fixed location in the top plate 15 and support plate 22. As shown in FIG. 2, the bolts 30 provide anchor points for translation and rotation of the elongated arms of the arm assemblies 25. Since only a single anchor point is provided for each arm assembly, the arm assemblies are not restricted to movement in a single degree-of-freedom, namely linearly along the axis of the elongated arm 26. Instead, each are is free to translate and rotate about the mounting bolt 30 as desired, and more particularly as needed to align with the transmission or component to be lowered by the lifting jack 12. The multiple degree-of-freedom movement capability of the arm assemblies 25 can be seen by comparing the configuration of the universal adaptor 20 in FIGS. 7-8.

In order to accommodate a wide range of angular orientations of the arm assemblies 25, the universal adaptor 20 of the present disclosure includes an arrangement of spacers 32*a*, 32*b*, 32*c* between the two plates 15, 22 and the elongated arms 26. The three spacers are provided with different heights h1, h2 and h3, corresponding to the spacers 32*a*, 32*b* and 32*c*, respectively. The height h1 is equal to the heights h2, h3 combined so that the single spacer 32*a* and the combination of the smaller spacers 32*b*, 32*c* maintain the two plates at a uniform spacing D. This spacing D is equal to the height h1 plus the thickness of the elongated arms 26, as shown in FIG. 3. The spacers 32*a*, 32*b*, 32*c* are selected for each elongated arm assembly to provide each arm assembly with the maximum angular degree of freedom possible. Thus, as shown in FIGS. 2-3, a spacer 32*a* is positioned beneath one elongated arm 25*a* (i.e., between the arm and the top plate 15) and the same size spacer 32*a* is positioned above a different arm 25*b* (i.e., between the arm and the support plate 22). For elongated arm 25*c* the smallest spacer 32*c* height h3) is beneath the arm (i.e., between the arm and the top plate 15) while the intermediate spacer 32*b* (height h2) is above the arm (i.e., between the arm and the support plate 22).

The spacers 32*a*, 32*b*, 32*c* support the weight of the support plate 22 and any component mounted thereon. In order for the arms 26 to remain free to rotate and translate even when the support plate is loaded with the transmission or other heavy component, the bushings 34 may be slightly thicker than the thickness of the arms 26. The bushings thus participate in bearing the weight along with the spacers 32 that contact the bushings. The thicker bushing thus insulates the arms 26 from the vertical load, thereby allowing the arms to move freely at any time.

Figure 7:
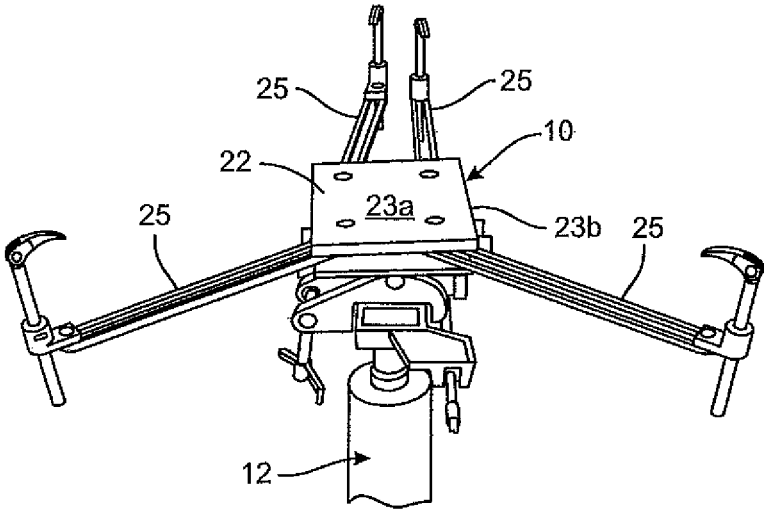
FIG. 7 is a top perspective view of the adaptor of FIG. 2 with the support arms of the adaptor in an extended position.
Figure 8:
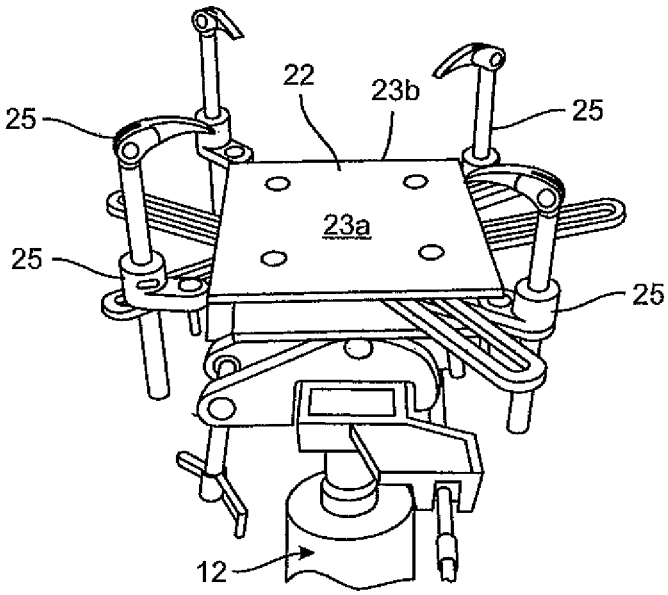
FIG. 8 is a top perspective view of the adaptor of FIG. 7 with the support arms of the adaptor in a retracted position.

In accordance with one feature of the present disclosure, the support arm assemblies are supported between the two plates in a manner that prevents the elongated arms 26 from striking each other. It can be appreciated that when the arms are fully retracted, as shown in FIGS. 2, 8, the inner ends of the arms will contact the spacers of the other arms, thereby limiting the available rotation angles in the retracted position. However, when the arms are extended, as shown in FIG. 7, the arms can rotate through a much wider angular range, limited only by contact mounting bolts of adjacent arm assemblies. As shown in FIG. 2, the mounting bolts 30 are positioned away from the center of the support plate 22 and closer to the corners of the plate. This places the rotation axis for the arm assemblies as outboard as possible when the arm is translated outward so that bolt contacts the inboard end 27*a* of the slot 27. In certain embodiments, each arm 26 can be fully retracted within the space between the plates 15, 22 with the bolt 30 in contact with the outboard end 27*b* of the slot 27. Depending on the dimensions of the support plate 22 a certain portion of the arm 26 may project beyond an opposite edge of the plate, as depicted in FIG. 2.

The slot 27 can have a width designed to allow for an additional swivel pad adaptor to be inserted anywhere along the length of the slot. This adaptor may be used if a particular clamping location is not available on the transmission. The adaptor may be threaded to allow a mounting bolt to pass through a bolt opening in the transmission body for bolting to the swivel pad adaptor.

The support arm assemblies 25 each support a corresponding holding assembly 40, as best illustrated in FIGS. 2, 4. The holding assembly 40 includes a mount 41 that with a base 41 configured to rest on the upper surface at the outboard end 29 of the arm 26. The base 41 defines a bore 42 for receiving a mounting bolt 43. The bolt passes through a corresponding bore 28 in the outboard end 29 of the arm and mates with a wing nut assembly 44 to fasten the mount 41 to the arm 26. The wing nut assembly 44 allows the mechanic/technician to manually tighten the bolt to clamp the holding assembly 40 to the arm assembly 25, or to manually loosen the bolt 43 to reposition the holding assembly.

The mount 41 is generally L-shaped with the base 41*a* forming the base of the L in contact with the arm 26, and an upstanding collar 41*b* projecting upward from the base. The upstanding collar 41*b* defines a through bore 46 configured to receive a holding rod 50 in sliding contact. The rod 50 and bore 46 are complementary configured and may be circular to allow the rod to rotate fully within the bore. Alternatively, the rod and bore may be non-circular to prevent the rod from rotating or to permit specific fixed angular positions of the rod within the bore. The rod 50 is free to slide vertically through the bore 46 and can be held in a particular vertical location by a locking assembly 53. The locking assembly 53 may be in the form of a T-bolt set screw that passes through a set screw bore 52 that intersects the through bore 46 and is configured to bear against the holding rod 50 therein. The locking assembly 53 may be of different configurations that are capable of applying sufficient pressure to the rod 50 to hold it in position relative to the mount 41. Thus, the locking assembly may include a knob 54 for rotating the set screw in a threaded engagement with the set screw bore 52. In a further alternative, the locking assembly may be in the form of a push-pull pin that can engage one of a series of holes spaced along the length of the rod 50.

As shown in FIGS. 2, 4, the mount 41 can be oriented on the arm 26 with the bore 46 positioned directly over the end 27*b* of the slot 27. The holding rod 50 can thus pass through both the mount 41 and the arm 26. Alternatively, the mount 41 can be rotated on the end 29 of the arm 26 so that the upstanding collar 41*b* of the mount is outboard of the arm 26, as depicted in FIG. 7, for instance. This feature allows for optimum positioning of the holding assembly 40 relative to a transmission being supported on the universal adaptor 20.

Figure 9:
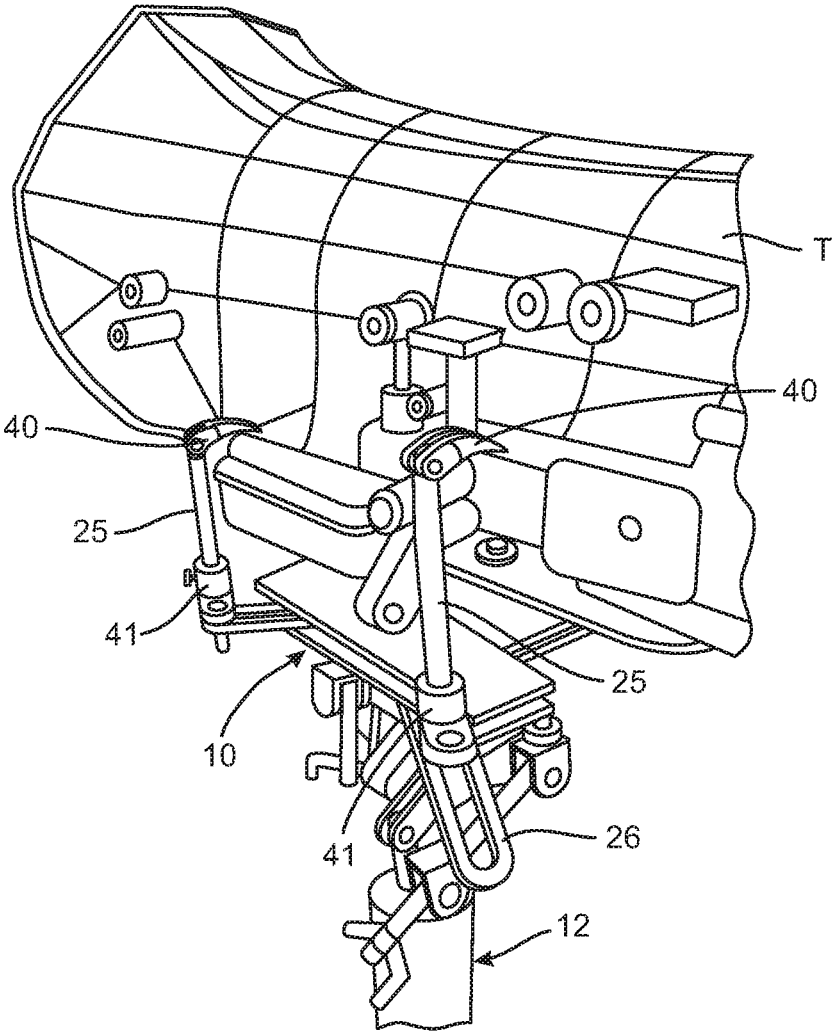
FIG. 9 is a perspective view of an automotive transmission supported and constrained by the adaptor of the present disclosure.

The holding assembly 40 further includes a holding element 55 at the upper end 51 of the holding rod 50. The holding element projects transversely from the holding rod and is configured to engage the casing of the transmission or other heavy component. As shown in FIGS. 1, 4, the holding element 55 can be generally hooked shaped to grasp features on the transmission case, such as the transmission mounting flange or oil pan flange. FIG. 9 depicts the holding assemblies 40 on one side of a transmission with one assembly engaging the oil pan flange and the other assembly engaging a projecting portion of the transmission case. FIG. 9 further illustrates a desirable range of vertical movement of the holding rod 50 to allow the holding assembly to find purchase at different locations on the transmission T.

The holding elements 55 may be fixed to the end 51 of the holding rod 50 at a predetermined angle of inclination. Alternatively, the holding elements may be fixable at or toggle between angles of inclination, or may be spring-biased to allow different inclinations upon contacting the transmission casing.

Figure 10:
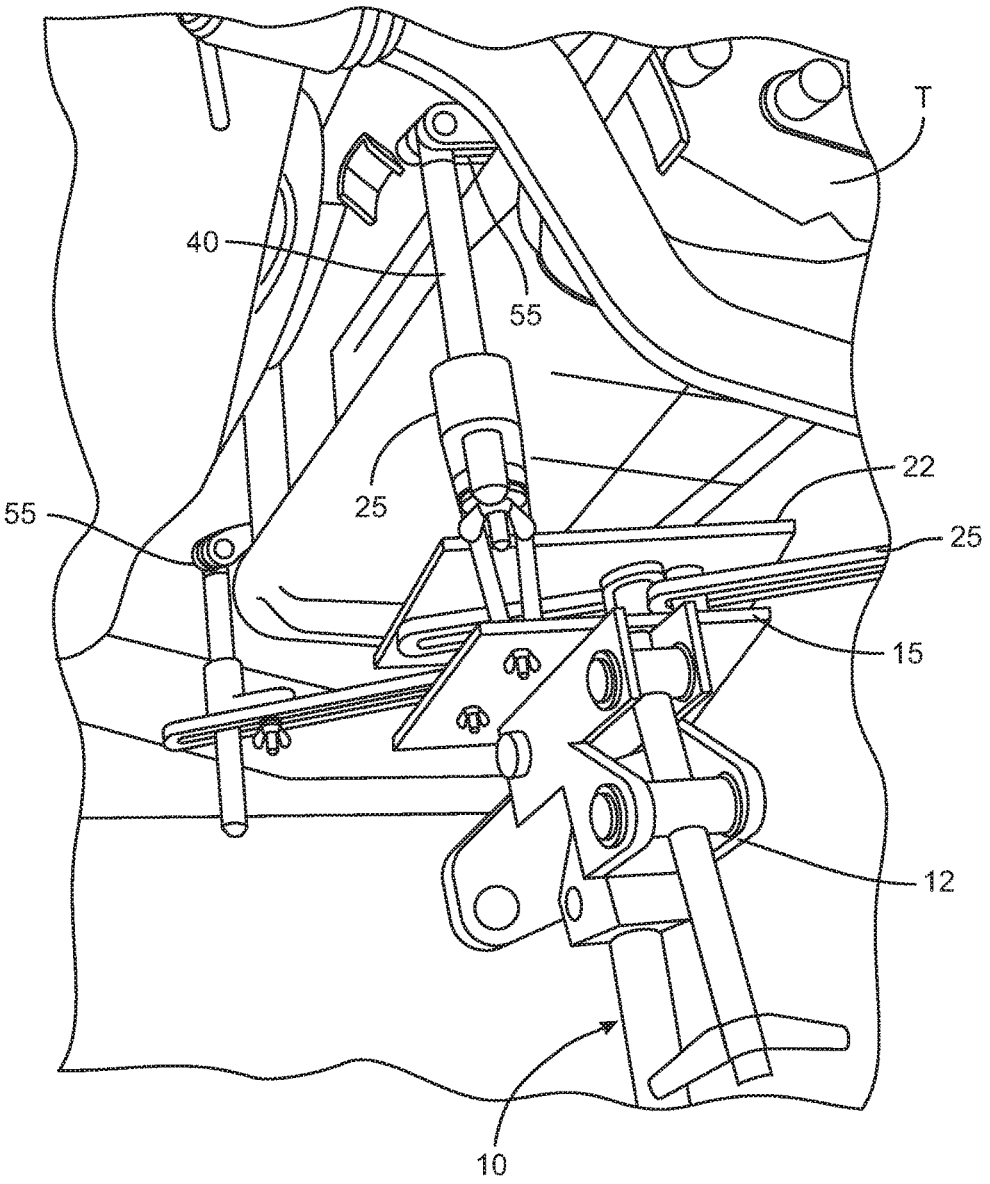
FIG. 10 is a perspective view of the underside of a vehicle illustrating one method of the present disclosure for engaging an automotive transmission with the adaptor of the present disclosure.

The universal adaptor 20 is shown in use in FIGS. 9, 10. A transmission T is supported by the adapter 20 on a conventional lifting jack 12 and is secured by the holding assemblies 40, two of which can be seen in FIG. 9. FIG. 10 depicts a scenario in which the lifting jack 12 has been elevated underneath a vehicle with the support plate 22 in contact with the oil pan of the transmission T while the transmission is still connected to the rest of the vehicle drive train. With the support plate 22 in position, the technician can manipulate the support arm assemblies 25 and holding assemblies 40 to provide optimum points of engagement between the holding elements 55 and the transmission casing. Once all of the holding assemblies have been engaged, the transmission T is stably supported and the technician can disconnect the transmission from the drive train and lower it to the position shown in FIG. 9.

The universal adaptor 20 is configured to support the weight of heavy components, such as an automotive transmission without bending, buckling or fracturing. Thus, the support plate 22 is formed of a strong metal in a thickness that can meet the strength needs identified above. The plate may thus be a ¼-½ inch thick steel plate. The plate may be configured to coincide with the horizontal plate 15 of the jack 12, such as in a square or rectangular configuration. However, the support plate 22 may have other configurations as desired to support a particular component, with the only limitation being that the bolt openings 24 defined in the plate 22 must coincide with the bolt openings in the jack plate 15.

The elongated arms 26 may also be formed of a strong metal, although the arms are not load-bearing in the same manner as the support plate 22. The arms may thus be formed of steel or aluminum or other suitable material. The spacers 32*a*, 32*b*, 32*c* and the bushings 34 carry the weight of the component being supported by the jack so they need to be formed of a material that can withstand high compressive loads. In addition, since the elongated arms may slide against these components the bushings 34 are preferably formed of a material that presents a low friction sliding surface for the arms. The spacers and bushings may be formed of a metal, such as steel, or may be formed of a high strength plastic or resin material. The holding rods 50 and holding elements 55 optimally do not bear any significant load, but they must be strong enough to withstand some lateral load as the heavy transmission shifts on the support plate 22. The rods and holding elements can thus be formed of a strong metal, such as steel.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An adaptor for a jack assembly having a jack carrying a horizontal plate for raising and lowering a heavy component supported by the jack assembly, comprising:

a horizontal support plate defining a support surface for supporting a component thereon and a perimeter around said support surface, said support plate vertically offset from the horizontal plate of the jack assembly by a height;

a plurality of elongated arms slidably mounted between the horizontal plate of the jack assembly and said support plate to move in a generally horizontal plane between the horizontal plate and said support plate at selectable angles in said horizontal plane relative to said support plate and at selectable horizontal extensions relative to said support plate beyond said perimeter of said support surface; and each of said plurality of elongated arms including a holding assembly configured to engage portions of the component supported on the support plate, wherein each of said plurality of elongated arms is mounted between the horizontal plate of the jack assembly and said support plate by a bolt that extends through said support plate, each of said plurality of elongated arms, and the horizontal plate of the jack assembly.

2. The adaptor of claim 1, wherein said holding assembly includes:

a mount fastened to one end of each of said plurality of elongated arms outside said perimeter of said support surface, said mount defining a bore therethrough;

a holding rod slidably extending through said bore;

a locking assembly disposed between said mount and said holding rod for locking said holding rod to said mount at variable vertical positions; and a holding element at one end of said holding rod configured to engage a portion of the component supported on said support plate.

3. The adaptor of claim 2, wherein said mount is fastened to each of said plurality of elongated arms by a bolt and manually tightenable wing nut.

4. An adaptor for a jack assembly having a jack carrying a horizontal plate for raising and lowering a heavy component supported by the jack assembly, comprising:

a horizontal support plate defining a support surface for supporting a component thereon and a perimeter around said support surface, said support plate vertically offset from the horizontal plate of the jack assembly by a height;

at least three elongated arms slidably mounted between the horizontal plate of the jack assembly and said support plate to move in a generally horizontal plane between the horizontal plate and said support plate at selectable angles in said horizontal plane relative to said support plate and at selectable horizontal extensions relative to said support plate beyond said perimeter of said support surface; and each of said at least three of elongated arms including a holding assembly configured to engage portions of the component supported on the support plate, wherein said at least three arms are each positioned at different vertical heights relative to the horizontal support plate and each of said at least three arms is slidably mounted to move in a different corresponding horizontal plane between the horizontal plate and said support plate.

5. The adaptor of claim 4, wherein each of said at least three of elongated arms is mounted between the horizontal plate of the jack assembly and said support plate by a bolt that extends through said support plate and the horizontal plate of the jack assembly.

6. The adaptor of claim 5, wherein said bolt is fastened to the horizontal plate by a manually tightenable wing nut.

7. The adaptor of claim 5, wherein each of said at least three elongated arms is mounted with only one bolt.

8. The adaptor of claim 5, wherein each of said at least three elongated arms defines an elongated slot and said bolt extends through said slot.

9. The adaptor of claim 4, further comprising at least one spacer associated with each of the at least three elongated arms and configured to position the associated elongated arm at one of said different vertical heights relative to said support plate.

10. The adaptor of claim 9, wherein the at least one spacer is selected from spacers having three different heights.

11. The adaptor of claim 10, wherein said spacers include a first spacer of height h1, a second spacer of height h2 and a third spacer of height h3, wherein h1=h2+h3.

12. The adaptor of claim 11, wherein:

a first arm of the at least three elongated arms includes only said first spacer positioned between said first arm and said support plate; and a second arm of the at least three elongated arms includes only said first spacer positioned between said second arm and the horizontal plate of the jack assembly.

13. The adaptor of claim 12, wherein:

a third arm of the at least three elongated arms includes only said second spacer and said third spacer, with said second spacer positioned between said third arm and said support plate and said third spacer positioned between said third arm and the horizontal plate of the jack assembly; and a fourth arm of the at least three elongated arms includes only said second spacer and said third spacer, with said third spacer positioned between said fourth arm and said support plate and said second spacer positioned between said fourth arm and the horizontal plate of the jack assembly.

14. The adaptor of claim 11, wherein:

a third arm of the at least three elongated arms includes only said second spacer and said third spacer, with said second spacer positioned between said third arm and said support plate and said third spacer positioned between said third arm and the horizontal plate of the jack assembly; and a fourth arm of the at least three elongated arms includes only said second spacer and said third spacer, with said third spacer positioned between said fourth arm and said support plate and said second spacer positioned between said fourth arm and the horizontal plate of the jack assembly.

15. The adaptor of claim 9, wherein each of said at least three elongated arms includes an elongated slot therethrough and is mounted between the horizontal plate of the jack assembly and said support plate by a bolt that extends through said support plate, through said slot and through the horizontal plate of the jack assembly.

16. The adaptor of claim 15, further comprising a bushing for each bolt, said bushing sized for a sliding fit within said slot, and said bushing having a thickness that is greater than the thickness of said elongated arm at said slot, wherein said at least one spacer bears against said bushing in the vertical direction between the horizontal plate of the jack assembly and said support plate.

* * * * *